US010344519B2

(12) United States Patent
Linden et al.

(10) Patent No.: US 10,344,519 B2
(45) Date of Patent: Jul. 9, 2019

(54) VEHICLE POWER DOOR SYSTEM

(71) Applicant: FORD GLOBAL TECHNOLOGIES, LLC, Dearborn, MI (US)

(72) Inventors: Howard Paul Tsvi Linden, Southfield, MI (US); Onoyom Essien Ekanem, White Lake, MI (US); Jevon Xiao, Palo Alto, CA (US); Christopher Matthew Radjewski, Macomb Township, MI (US); Muhammad Omer Khan, Ypsilanti, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 248 days.

(21) Appl. No.: 15/484,458

(22) Filed: Apr. 11, 2017

(65) Prior Publication Data

US 2018/0291666 A1 Oct. 11, 2018

(51) Int. Cl.
*E05F 15/20* (2006.01)
*E05F 5/02* (2006.01)
(Continued)

(52) U.S. Cl.
CPC ..... *E05F 5/025* (2013.01); *E05B 81/76* (2013.01); *E05C 17/006* (2013.01); *E05F 15/40* (2015.01);
(Continued)

(58) Field of Classification Search
CPC ..... E05F 15/611; E05F 15/70; E05F 15/00; E05F 5/025; E05F 15/76; E05Y 2900/531;
(Continued)

(56) References Cited

U.S. PATENT DOCUMENTS 3,398,484 A * 8/1968 Katsumura ..... E05F 15/622 318/268
4,530,185 A 7/1985 Moriya et al.
4,674,230 A * 6/1987 Takeo ..... E05C 17/003 49/28
5,468,042 A * 11/1995 Heinrichs ..... E05C 17/305 16/51
7,509,772 B2 3/2009 Ohta et al.
(Continued)

FOREIGN PATENT DOCUMENTS

DE 202015101408 U1 4/2015
JP 2005226297 A 8/2005
KR 101080759 B1 11/2011

OTHER PUBLICATIONS

English Machine Translation of KR101080759B1.
English Machine Translation of JP2005226297A.
English Machine Translation of DE202015101408U1.

*Primary Examiner* — Chi Q Nguyen
(74) *Attorney, Agent, or Firm* — Jason Rogers; Vichit Chea; King & Schickli PLLC

(57) ABSTRACT

A power door system for a vehicle includes a door connected to a vehicle body, a door actuator comprising a clutch and a braking system and adapted to displace the door between a plurality of open positions and a fully closed position, and a controller system configured to disengage the clutch on determination of a manual door open or close operation. The controller system is further configured to engage the braking system on a determination that the manual door close operation exceeds a threshold door closing speed. The controller system is further configured to cause the braking system to stop the manual door close operation exceeding the threshold door closing speed at a spaced distance from the vehicle body, to re-engage the clutch, and to actuate a power cinch function to displace the door to the fully closed position.

20 Claims, 4 Drawing Sheets

(51) Int. Cl.

| | |
|---|---|
| ***E05F 15/611*** | (2015.01) |
| ***E05F 15/73*** | (2015.01) |
| ***E05B 81/76*** | (2014.01) |
| ***E05F 15/40*** | (2015.01) |
| ***E05F 15/70*** | (2015.01) |
| ***E05C 17/00*** | (2006.01) |

(52) U.S. Cl.
CPC ..... *E05F 15/611* (2015.01); *E05F 15/70* (2015.01); *E05F 15/73* (2015.01); *E05Y 2900/531* (2013.01)

(58) Field of Classification Search
CPC ..... E05Y 2400/32; E05B 81/32; E05B 81/56; B60J 5/00
USPC ..... 49/31, 279, 29, 30, 28, 333, 338, 339, 49/340, 348, 334
See application file for complete search history.

(56) References Cited

U.S. PATENT DOCUMENTS

| | | | | |
|---|---|---|---|---|
| 8,234,817 | B2 | 8/2012 | Neundorf et al. | |
| 9,174,517 | B2 * | 11/2015 | Scheuring | F16H 25/2015 |
| 9,850,695 | B2 * | 12/2017 | Torres Fernandez | E05F 15/40 |
| 9,879,463 | B2 * | 1/2018 | Lombrozo | E05F 15/627 |
| 2006/0151231 | A1 * | 7/2006 | Bucksch | E05F 15/40 180/337 |
| 2009/0051192 | A1 * | 2/2009 | Ewing | E05F 15/622 296/146.2 |
| 2009/0217596 | A1 * | 9/2009 | Neundorf | E05B 81/20 49/506 |
| 2013/0038081 | A1 * | 2/2013 | Kerr, III | B60J 5/108 296/57.1 |
| 2013/0169087 | A1 * | 7/2013 | Kummer | E05F 5/00 310/76 |
| 2014/0053370 | A1 * | 2/2014 | Tseng | E05C 17/203 16/82 |
| 2017/0030737 | A1 * | 2/2017 | Elie | E05F 15/70 |

* cited by examiner

VEHICLE POWER DOOR SYSTEM

TECHNICAL FIELD

This disclosure relates generally to power doors for motor vehicles. More particularly, this disclosure relates to a power door system allowing a smooth transition between power and manual operating modes, and which further is configured to compensate for a detected door "over-slam" condition.

BACKGROUND

It is known to equip vehicle doors with power mechanisms allowing automated opening/closing and locking/unlocking. Such mechanisms provide significant convenience, particularly for very young, impaired or handicapped individuals. Power doors typically retain manual operative function, that is, can be opened/closed manually as well as by the power mechanisms. However, power mechanisms are often not able to smoothly transition between power function and manual function. This can particularly be true during an overly rapid door closing action, i.e. a door "over-slam" condition. If a user attempts to slam a door manually with the power mechanism engaged, damage to the mechanism may occur.

There is accordingly identified a need in the art for improvements to power door mechanism.

SUMMARY

In accordance with the purposes and benefits described herein, in one aspect a power door system for a vehicle is provided, comprising a door connected to a vehicle body a door actuator comprising a clutch and a braking system and adapted to displace the door between a plurality of open positions and a fully closed position, and a controller system configured to disengage the clutch on determination of a manual door open or close operation. In embodiments, the clutch is an electromagnetic clutch and the braking system is an electromagnetic braking system. The door actuator may comprise a motor operatively connected to a checkstrap, wherein the clutch is disposed between the motor and the check strap and the braking system is disposed in a housing for the motor. The power door system may further comprise a power cinch function.

In embodiments, the controller system comprises at least a Body Control Module and one or more Electronic Control Modules. The controller system may be configured to engage the braking system on a determination that the manual door close operation exceeds a threshold door closing speed or force. The controller system may be further configured to cause the braking system to stop the manual door close operation exceeding the threshold door closing speed at a spaced distance from the vehicle body, to re-engage the clutch, and to actuate the power cinch function to displace the door to the fully closed position.

In embodiments, one or more proximity sensors communicating with the controller system may be associated with the door. Further, one or more position sensors communicating with the controller system may be associated with the door. In embodiments, the controller system is configured to receive a door lock/unlock and/or open/close command received from one or more switches disposed in a passenger cabin of the vehicle, one or more door handle sensors detecting a manual operation of a handle of the door, and one or more vehicle-exterior devices.

In another aspect, a method is described for controlling a power door system for a vehicle substantially as described above. The method comprises, by the controller system, receiving an input indicative of a manual door open or close operation and by the controller system, disengaging the electromagnetic clutch. The method comprises engaging the electromagnetic braking system on a determination by the controller system that the manual door close operation exceeds a threshold door closing speed or force. The method further comprises, by the controller system, causing the electromagnetic braking system to stop the manual door close operation exceeding the threshold door closing speed at a spaced distance from the vehicle body, to re-engage the electromagnetic clutch, and to actuate the power cinch function to displace the door to the fully closed position.

In embodiments, the method comprises determining that the manual door close operation exceeds a threshold door closing force or speed by one or more position sensors associated with the door. The method may further include configuring the controller system to receive a door lock/unlock and/or open/close command received from one or more switches disposed in a passenger cabin of the vehicle, one or more door handle sensors detecting a manual operation of a handle of the door, and one or more vehicle-exterior devices.

In the following description, there are shown and described embodiments of the disclosed power door system and attendant methods. As it should be realized, the systems and methods are capable of other, different embodiments and their several details are capable of modification in various, obvious aspects all without departing from the devices and methods as set forth and described in the following claims. Accordingly, the drawings and descriptions should be regarded as illustrative in nature and not as restrictive.

BRIEF DESCRIPTION OF THE DRAWINGS

The accompanying drawing figures incorporated herein and forming a part of the specification, illustrate several aspects of the disclosed power door system and attendant methods, and together with the description serve to explain certain principles thereof. In the drawing.

Reference will now be made in detail to embodiments of the disclosed power door system and attendant methods, examples of which are illustrated in the accompanying drawing figures.

DETAILED DESCRIPTION

Figure 1:
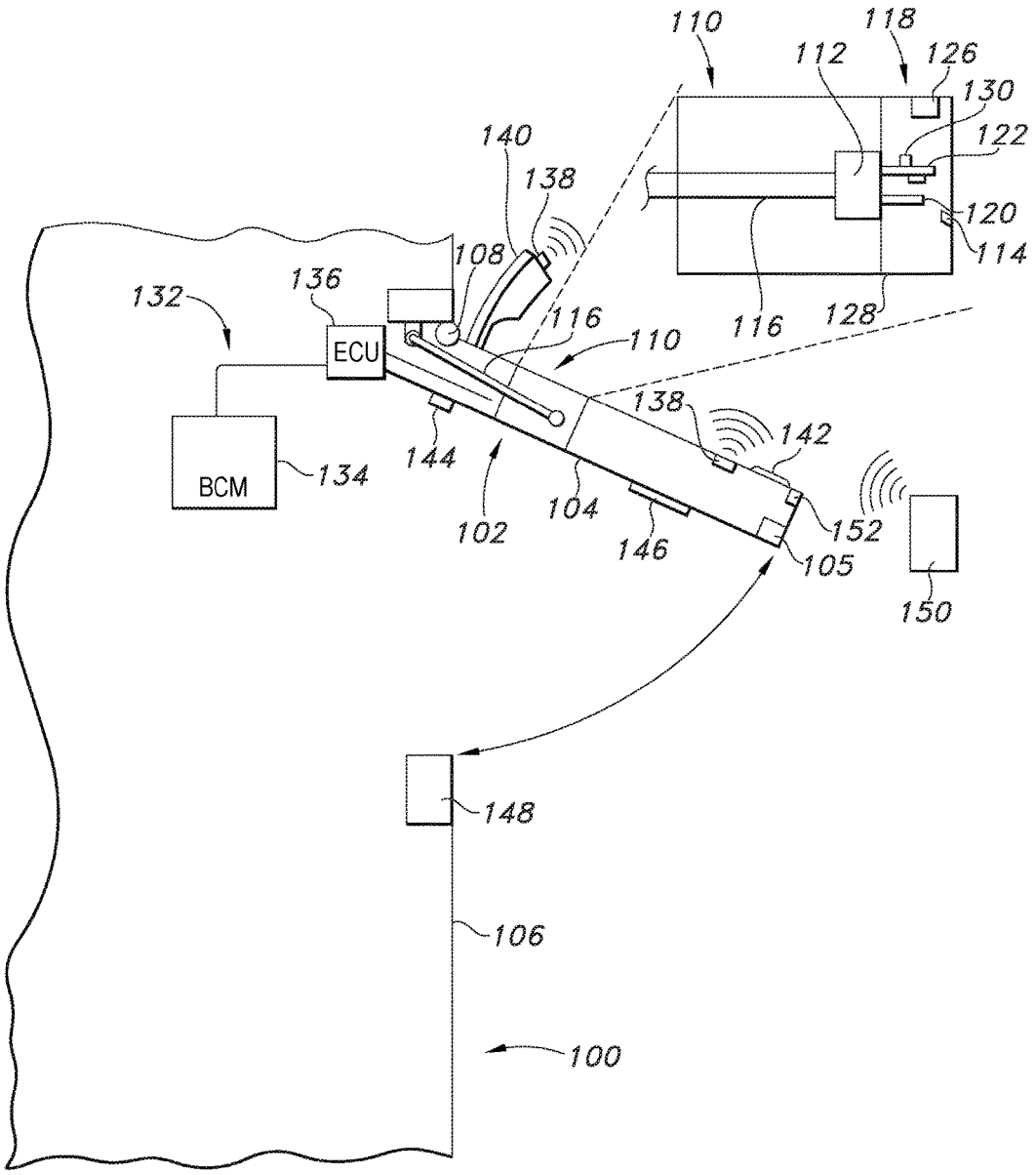
FIG. 1 shows a vehicle equipped with a power door lock system according to the present disclosure.

Preliminarily, the present disclosure is directed to a power door system used in association with a power-operated, side-hinged vehicle-fore-or-aft opening swinging door as shown in FIG. 1. However, it will be readily appreciated by the skilled artisan that the described system is easily adaptable to any power-operated door or closure, including without intending any limitation sliding doors, roof-hinged vehicle-up-down raising or "gull-wing" doors, lift-gates, hatch-back doors, and others. Accordingly, the present description should not be taken as limiting in that regard.

Turning to FIG. 1, a vehicle 100 is shown including a power door system 102 according to the present disclosure. The vehicle 100 includes a hinged door 104 having a latch assembly 105 and attached to the vehicle body 106 by at least one hinge 108, and further includes a door actuator 110. As shown in the inset, the door actuator 110 includes a clutch 112 and a braking system 114 which as will be described is adapted to displace the door 104 between a fully closed position and a plurality of open positions. The door actuator 110 further includes a checkstrap 116. Any suitable checkstrap 116 design is contemplated. However, in the depicted embodiment a smooth or "infinite" checkstrap 116 is used, which as will be appreciated allows a near-infinite number of positions or stops between a door 104 fully closed position and a door fully opened position.

In the depicted embodiment, the clutch 112 is an electromagnetic clutch and the braking system 114 is likewise an electromagnetic brake. However, other clutch and/or brake designs are known in the art, and are contemplated for use herein. As shown, the electromagnetic clutch 112 is disposed between the checkstrap 116 and a door actuator motor 118, and by its use the motor can be disengaged from the checkstrap for manual operation of the door 104.

The door actuator motor 118 shaft 120 includes an upper arm 122. In the depicted embodiment, the braking system 114 comprises a first electromagnet 124 mounted to the upper arm 122 of the motor 118 shaft 120, and a second electromagnet 126 mounted to a housing 128 for the motor 118. As will be appreciated, energizing the magnets 124, 126 will create a magnetic field which slows rotation of the motor 118 shaft, acting as a brake.

The door actuator motor 118 further includes one or more position sensors 130 attached to the upper arm 122. In the depicted embodiment, the position sensors 130 are Hall effect sensors of known design, capable of determining a position and thereby a rate of rotation of the motor shaft upper arm 122. As will be appreciated, this allows determining a speed of opening/closing of door 104 which as will be described below allows detecting and correcting for an overly fast door closing or "over-slam" condition.

The power door system 102 further includes a controller system 132, in the depicted embodiment being a Body Control Module 134 in operative communication with a door Electronic Control Unit 136. In addition to being in operative communication with the components of the above-described door actuator 110, the controller system 132 is in operative communication with a variety of sensors. These may variously include one or more proximity sensors 138 associated with portions of the door 104, such as a side view mirror 140 or an exterior door handle 142. In embodiments use of ultrasonic proximity sensors 138 is contemplated, although other suitable proximity sensors are known in the art and contemplated for use herein.

The controller system 132 may also be in operative communication with a variety of door-actuating devices, including without intending any limitation door-mounted switches 144, interior door handles 146, and others. A door power cinch system is provided, to allow a "soft-close" function for the power door system 102. This may include a power-actuated latch 148, also in operative communication with the controller system 132.

Operation of components of the power door system 102 by a variety of devices is contemplated. This may include the door-mounted switches 144, interior door handles 146, and others referenced above. Use of a variety of vehicle-exterior devices 150 communicating with door-mounted sensors 152 is also contemplated. Non-limiting examples of vehicle-exterior devices 150 which may effect door 104 lock/unlock, latch/unlatch, and power open/close functions include keys, keyfobs, passive entry/passive start devices (so-called "smartkeys"), devices such as smartphones equipped with phone-as-a-key functionality, keypads, and others. The function of such devices is well-known in the art, and does not require extensive description herein.

Figure 2:
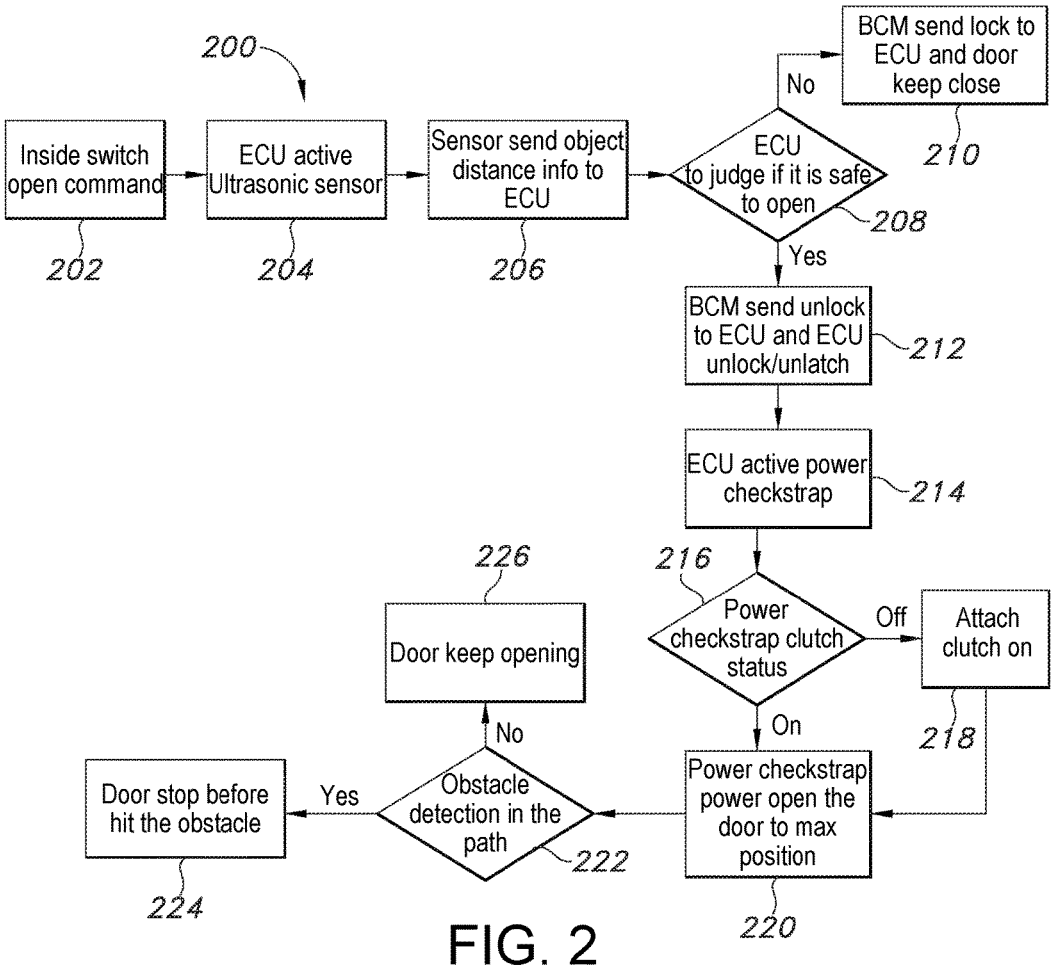
FIG. 2 depicts in flow chart form a method for a power door system open operation according to the present disclosure.

FIG. 2 illustrates in flow chart form a method 200 for opening a power door system 102 in power mode. In this embodiment, an "open door" command (step 202) has been provided by a user using a switch 144 disposed in an interior of the vehicle 100, for example a door-mounted, dashboard-mounted, or other switch. At step 204, the door ECU 136 activates the one or more proximity sensors 138 disposed on the door 104 to be opened. At step 206, the one or more proximity sensors 138 send inputs to the door ECU 136 indicative of the presence and/or distance of a potential obstacle to the opening of the door 104. From these inputs, the door ECU 136 determines the safety, or not, of opening the door 104 (step 208), i.e. whether an obstacle (not shown) has been detected within a detection radius encompassing a path of travel of a portion of the door 104 from the fully closed to the fully opened position. If an obstacle is detected, the BCM 134 causes the door ECU 136 to retain the door 104 in the closed position (step 210).

If no obstacle is detected, the BCU causes the door ECU 136 to unlock/unlatch the power door latch 148 (step 212). Next, at step 214 the door ECU 136 activates the power door motor 118/checkstrap 116, and at step 216 determines the electromagnetic clutch 112 status. If the electromagnetic clutch 112 is disengaged, at step 218 the door ECU 136 engages it. If the electromagnetic clutch 112 is engaged, at step 220 the door ECU actuates the motor 118 to extend the power checkstrap 116 to open the door 104 to a fully open position. If at any point during the door 104 opening an obstacle is detected (step 222), the ECU engages the braking system 114 to prevent the door from continuing to open (step 224). If not, the door 104 opens to the fully open position (step 226).

Figure 3:
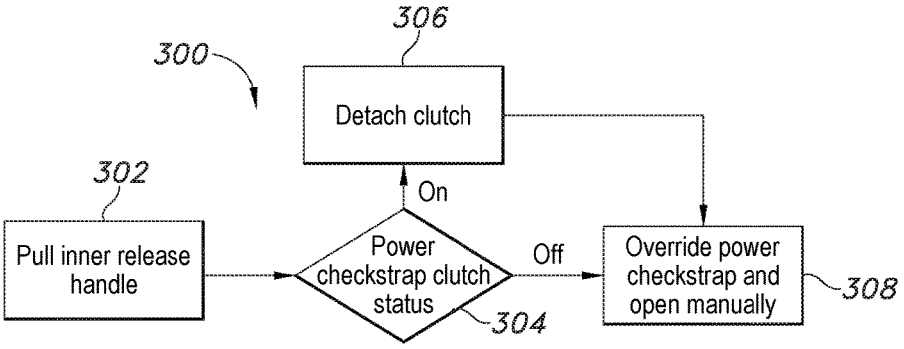
FIG. 3 depicts in flow chart form a method for a power door system manual open operation according to the present disclosure.

FIG. 3 illustrates in flow chart form a method 300 for manually opening a power door system 102. At step 302, a user manually opens the door 104, such as by an inner release handle 146. Next, the door ECU determines the electromagnetic clutch 112 status (step 304). If the electromagnetic clutch 112 is engaged, at step 306 the door ECU disengages the electromagnetic clutch to over-ride the power motor 118/checkstrap 116. If the electromagnetic clutch 112 is disengaged, the door 104 manual opening procedure continues (step 308). As will be appreciated, by these steps 304, 306 of determining an electromagnetic clutch 112 status and disengaging the clutch if needed, a smooth transition between a power operating mode and a manual operating mode is ensured for the power door system 102.

Figure 4:
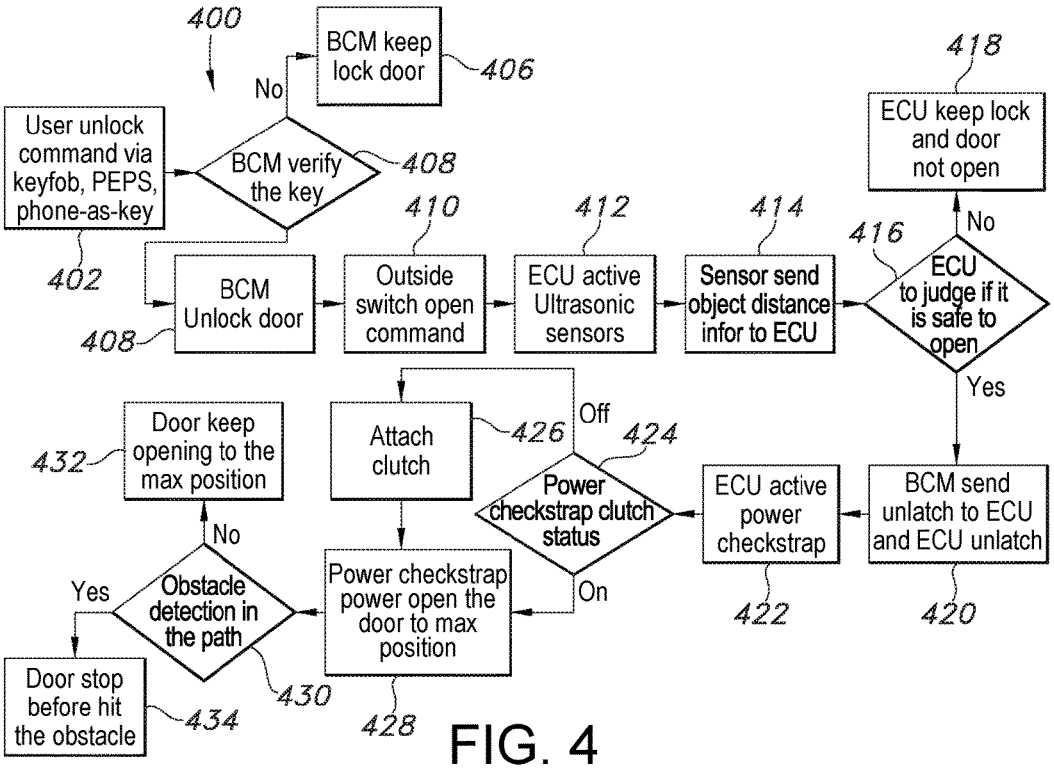
FIG. 4 depicts in flow chart form an alternative embodiment of a method for a power door system open operation according to the present disclosure.

FIG. 4 illustrates in flow chart form an alternative embodiment of a method 400 for opening a locked power door system 102 in power mode. At step 402, an unlock command is provided from a vehicle-exterior device 150 as described above. At step 404, the BCM 134 authenticates the vehicle-exterior device 150 to ensure that unauthorized entry is not sought. If the vehicle-exterior device 150 is not authenticated, i.e. the emitted signal does not come from an authorized device, the input passkey is not correct, etc., at step 406 the BCM 134 maintains the locked status of the door 104. If the vehicle-exterior device 150 is authorized/authenticated, at step 408 the BCM 134 causes the door ECU 136 to unlock the door 104. Next, at step 410 a "power open" command input is issued by the vehicle-exterior device 150. From this step, the method proceeds substantially as described above for FIG. 2, steps 204 et seq.

Figure 5:
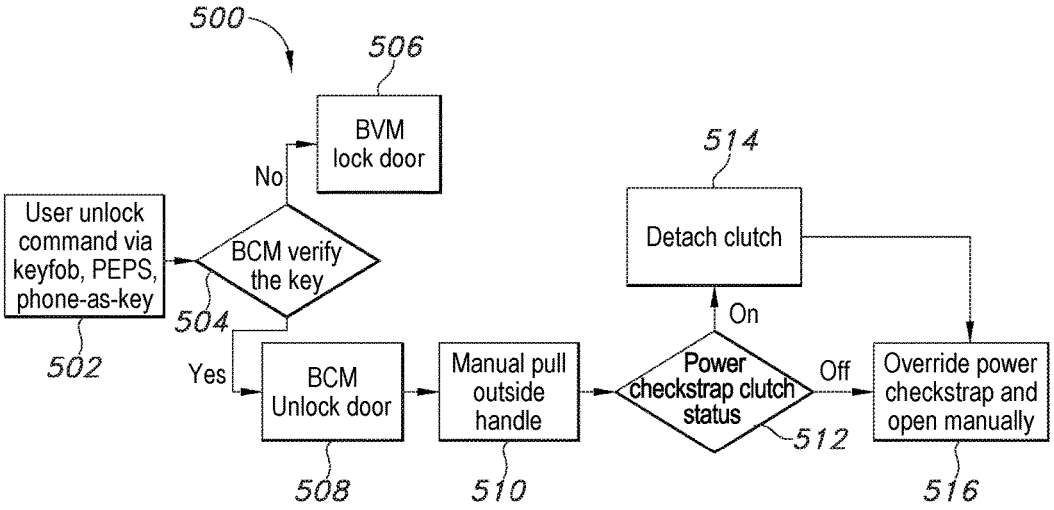
FIG. 5 depicts in flow chart form an alternative embodiment of a power door manual open operation system according to the present disclosure.

FIG. 5 illustrates in flow chart form an alternative embodiment of a method 500 for manually opening a power door system 102. At step 502, an unlock command is provided from a vehicle-exterior device 150 as described above. At step 504, the BCM 134 authenticates the vehicle-exterior device 150 to ensure that unauthorized entry is not sought. If the vehicle-exterior device 150 is not authenticated, i.e. the emitted signal does not come from an authorized device, the input passkey is not correct, etc., at step 506 the BCM 134 maintains the locked status of the door 104. If the vehicle-exterior device 150 is authorized/authenticated, at step 508 the BCM 134 causes the door ECU 136 to unlock the door 104. At step 510, a user manually actuates an exterior door handle 142 to manually open the door. The door ECU 136 determines the electromagnetic clutch 112 status (step 512). If the electromagnetic clutch 112 is engaged, at step 514 the door ECU 136 disengages the electromagnetic clutch to over-ride the power door motor 118/checkstrap 116. If the electromagnetic clutch 112 is disengaged, the door 104 manual opening procedure continues (step 516). Again, this ensures a smooth transition between a power operating mode and a manual operating mode for the power door system 102.

Figure 6:
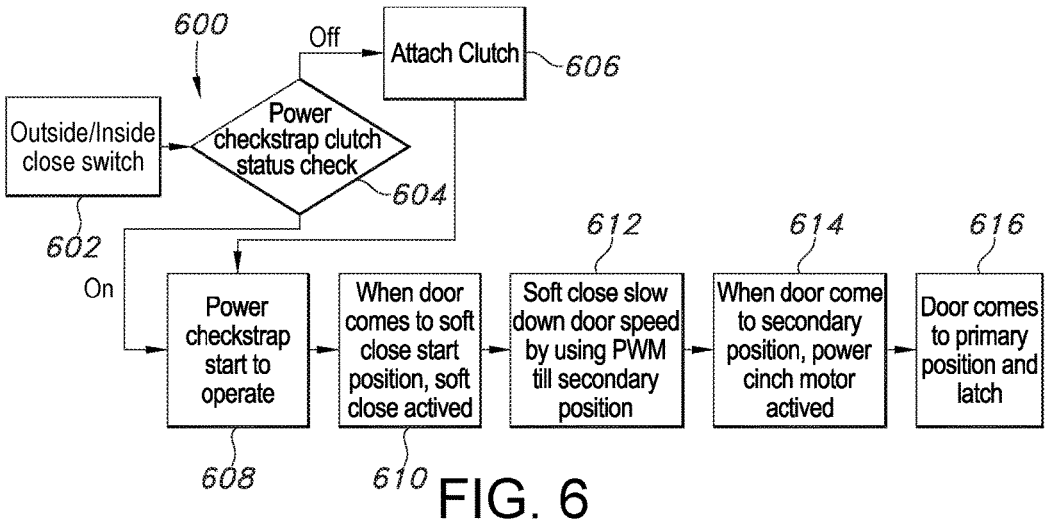
FIG. 6 depicts in flow chart form a method for a power door system close operation according to the present disclosure.

FIG. 6 illustrates in flow chart form a method 600 for closing a power door system from a fully open position to a fully closed position in power mode. At step 602, a "door close" input is received from a vehicle-interior switch 144 or vehicle-exterior device 150. At step 604, the door ECU 136 determines the electromagnetic clutch 112 status. If the electromagnetic clutch 112 is disengaged, at step 606 the door ECU 136 engages the electromagnetic clutch to enable operation of the door 104 by the power door motor 118/checkstrap 116. If the electromagnetic clutch 112 is engaged, the door 104 manual opening procedure continues (step 608) by actuating the motor 118 to cause the power checkstrap 116 to close the door to a spaced distance from the vehicle body 106.

When the door 104 is determined by the position sensor 130 to be at the spaced distance from the vehicle body 106, a "soft close" function is initiated by the BCM 134 (step 610). This "soft close" function, as is known in the art, comprises reducing a closing speed of the door 104 (step 612). This may be accomplished by a variety of means, including without intending any limitation by reducing a voltage supplied to the motor 118, for example by a pulse width modulator (PWM). As the door 104 is closed to a next spaced distance from the vehicle body 106, a power cinch function is actuated by the door ECU 136 under control of the BCM 134 (step 614). The power door motor 118/checkstrap 116 bring the door 104 to a final, fully closed position, and the power door latch 148 is actuated by the door ECU 136 under control of the BCM 134 (step 616).

Figure 7:
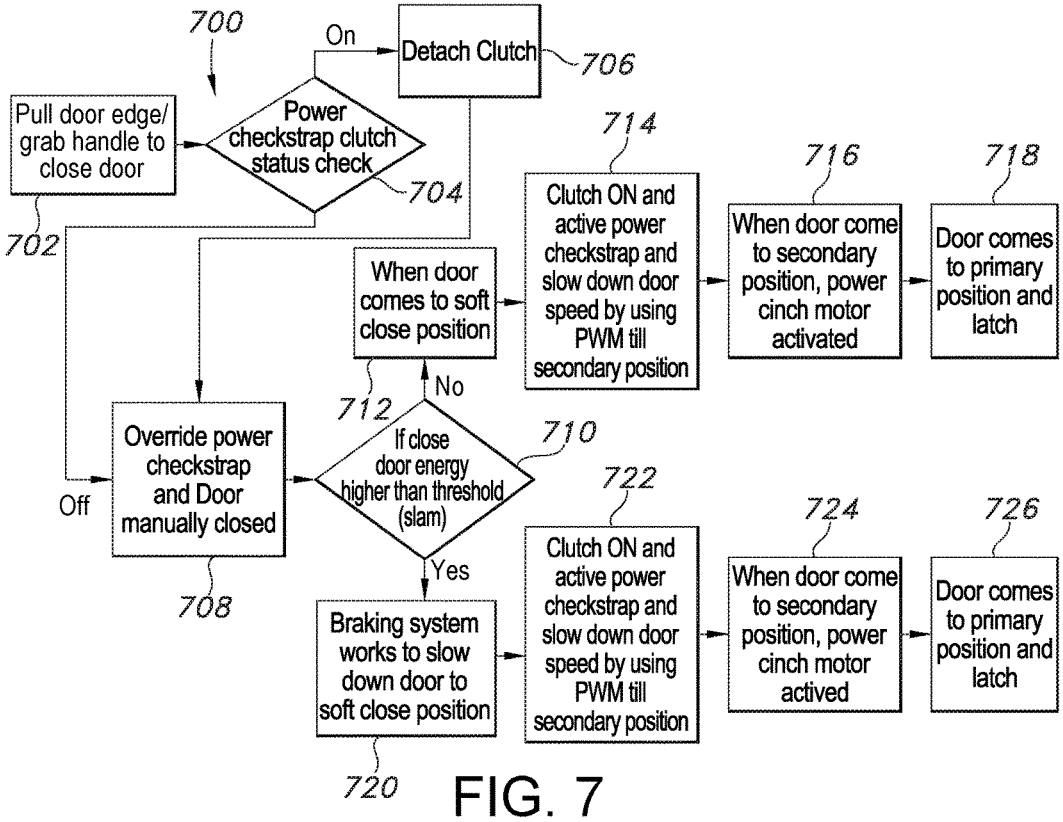
FIG. 7 depicts in flow chart form a method for a power door system manual close operation according to the present disclosure.

FIG. 7 illustrates in flow chart form a method 700 for manually closing a power door system 102 from a fully open position to a fully closed position, including methods for compensating for a door "over slam" condition, i.e. a closing action for the door 104 at a speed or force potentially risking injury to an occupant or damage to the door in the event an obstacle is placed in the closing door's path. At step 702, a user manually grasps a portion of the door 104 and initiates the closing. Next, the door ECU 136 determines the electromagnetic clutch 112 status (step 704). If the electromagnetic clutch 112 is engaged, at step 706 the door ECU 136 disengages the electromagnetic clutch to over-ride the power door motor 118/checkstrap 116. If the electromagnetic clutch 112 is disengaged, the door 104 manual opening procedure continues (step 708).

Next, at step 710 a closing speed/force of the door 104 is determined. This may be provided as an input to the BCM 134 from the position sensor 130. The input is indicative of the speed or force with which the user is closing the door 104. A closing speed/force less than a predetermined threshold will be interpreted as a normal manual closing, and the manual closing proceeds (step 712). In one possible embodiment, a closing speed/force of 0.25 m/sec provides the desired threshold. However, it will be readily appreciated that this value may vary according to door 104 size, weight, and other factors. At step 712, when the door 104 is determined by the position sensor 130 to be at the spaced distance from the vehicle body 106, the "soft close" function as described above for FIG. 6, beginning at step 610, proceeds and the door is closed/latched as described (steps 712-718).

On the other hand, if the door 104 closing speed/force is determined to equal or exceed the predetermined threshold, the door ECU 136 under control of the BCM 134 causes the braking system 114 to engage to reduce the closing speed/force of the door until the door reaches the predetermined distance from the vehicle body 106 (step 720). At the predetermined distance, the closing speed of the door 104 is reduced and the electromagnetic clutch 112 is engaged by the door ECU 136 under control of the BCM 134 (step 722). Again, the door 104 closing speed/force may be reduced by reducing a voltage supplied to the motor 118, for example by a pulse width modulator (PWM). As the door 104 is closed to a next spaced distance from the vehicle body 106, the power cinch function as described above is actuated by the door ECU 136 under control of the BCM 134 (step 724). The power cinch function brings the door 104 to a final, fully closed position, and the door power latch 148 is actuated by the door ECU 136 under control of the BCM 134 (step 726). Thus, even if the user is overly enthusiastic in the amount of force applied to close the door 104, an actual door slam does not occur.

As will be appreciated, by these steps of confirming disengagement or disengaging the electromagnetic clutch 112 (step 704) and use of the braking system 114 (step 720), smooth transitions between the manual modes and the power modes described above are possible, reducing the risk of damage to the electromagnetic clutch particularly in a door 104 "over slam" condition. In turn, eliminating the possibility of a door slam enhances sound performance and user satisfaction.

Obvious modifications and variations are possible in light of the above teachings. For example, the described systems and methods are conveniently implemented by way of the described controller system communicating with/controlling an electromagnetic clutch and electromagnetic braking system as described. However, alternative clutch and braking system designs are known and are contemplated for use herein. All such modifications and variations are within the scope of the appended claims when interpreted in accordance with the breadth to which they are fairly, legally and equitably entitled.

What is claimed:

1. A power door system for a vehicle, comprising:

a door connected to a vehicle body;

a door actuator comprising a clutch and a braking system and adapted to displace the door between a plurality of open positions and a fully closed position; and a controller system configured to disengage the clutch on determination of a manual door open or close operation.

2. The system of claim 1, wherein the controller system comprises at least a Body Control Module and one or more Electronic Control Modules.

3. The system of claim 2, wherein the clutch is an electromagnetic clutch and the braking system is an electromagnetic braking system.

4. The system of claim 2, wherein the controller system is further configured to engage the braking system on a determination that the manual door close operation exceeds a threshold door closing speed.

5. The system of claim 4, further comprising a power cinch function.

6. The system of claim 5, wherein the controller system is further configured to cause the braking system to stop the manual door close operation exceeding the threshold door closing speed at a spaced distance from the vehicle body, to re-engage the clutch, and to actuate the power cinch function to displace the door to the fully closed position.

7. The system of claim 2, wherein the door actuator further comprises a motor operatively connected to a check strap.

8. The system of claim 7, wherein the clutch is disposed between the motor and the check strap.

9. The system of claim 7, wherein the braking system is disposed in a housing for the motor.

10. The system of claim 2, further including one or more proximity sensors associated with the door and communicating with the controller system.

11. The system of claim 2, further including one or more position sensors associated with the door and communicating with the controller system.

12. The system of claim 2, wherein the controller system is configured to receive one or both of a door lock/unlock and an open/close command received from one or more switches disposed in a passenger cabin of the vehicle, one or more door handle sensors detecting a manual operation of a handle of the door, and one or more vehicle-exterior devices.

13. A vehicle including the power door system of claim 1.

14. In a vehicle having a power door system comprising a door, a door actuator comprising an electromagnetic clutch and an electromagnetic braking system and adapted to displace the door between a plurality of open positions and a fully closed position, a power cinch function, and a controller system, a method comprising:

by the controller system, receiving an input indicative of a manual door open or close operation; and by the controller system, disengaging the electromagnetic clutch.

15. The method of claim 14, including providing the controller system comprising at least a Body Control Module and one or more Electronic Control Modules.

16. The method of claim 14, further including engaging the electromagnetic braking system on a determination by the controller system that the manual door close operation exceeds a threshold door closing speed.

17. The method of claim 16, further including, by the controller system, causing the electromagnetic braking system to stop the manual door close operation exceeding the threshold door closing speed at a spaced distance from the vehicle body, to re-engage the electromagnetic clutch, and to actuate the power cinch function to displace the door to the fully closed position.

18. The method of claim 16, including, by the controller system, determining that the manual door close operation exceeds a threshold door closing speed by one or more position sensors associated with the door.

19. The method of claim 14, further including configuring the controller system to receive one or both of a door lock/unlock and an open/close command received from one or more switches disposed in a passenger cabin of the vehicle, one or more door handle sensors detecting a manual operation of a handle of the door, and one or more vehicle-exterior devices.

20. The method of claim 14, further including providing one or more proximity sensors associated with the door and communicating with the controller system.

* * * * *